US006923480B2

(12) United States Patent
Shafry

(10) Patent No.: US 6,923,480 B2
(45) Date of Patent: Aug. 2, 2005

(54) ACTUATING DEVICE

(75) Inventor: Gavriel Shafry, Wermelskirchen (DE)

(73) Assignee: Intier Automotive Closures Inc., Newmarket (CA)

( * ) Notice: Subject to any disclaimer, the term of this patent is extended or adjusted under 35 U.S.C. 154(b) by 0 days.

(21) Appl. No.: 10/460,902

(22) Filed: Jun. 13, 2003

(65) Prior Publication Data

US 2004/0046399 A1 Mar. 11, 2004

(51) Int. Cl.[7] ..... E05C 3/06
(52) U.S. Cl. ..... 292/201; 292/216
(58) Field of Search ..... 292/201, 216, 292/341.16; 70/277

(56) References Cited

U.S. PATENT DOCUMENTS

| | | | | |
|---|---|---|---|---|
| 4,194,377 A | * | 3/1980 | Maeda | 70/360 |
| 5,934,717 A | * | 8/1999 | Wirths et al. | 292/201 |
| 6,155,124 A | * | 12/2000 | Wirths | 74/89.13 |
| 6,439,623 B1 | * | 8/2002 | Lohfeld et al. | 292/201 |
| 6,471,259 B1 | * | 10/2002 | Weyerstall et al. | 292/201 |
| 6,575,507 B2 | * | 6/2003 | Reddmann | 292/216 |
| 6,648,380 B1 | * | 11/2003 | Szablewski et al. | 292/201 |
| 6,705,649 B1 | * | 3/2004 | Reddmann | 292/216 |

FOREIGN PATENT DOCUMENTS

| | | |
|---|---|---|
| DE | 3605 601 C1 | 2/1986 |
| DE | 40 28 992 A1 | 9/1990 |
| DE | 196 31 869 A1 | 8/1996 |
| DE | 199 04 663 C2 | 2/1999 |
| DE | 199 13 590 A1 | 3/1999 |
| DE | 199 61 247 A1 | 12/1999 |
| EP | 0 711 891 B1 | 10/1995 |

* cited by examiner

*Primary Examiner*—Gary Estremsky
(74) *Attorney, Agent, or Firm*—Clark Hill PC

(57) ABSTRACT

An actuating device, particularly for a vehicle door lock, having a cam wheel (11) comprising at least one cam (13), the cam wheel being selectively rotatable about a rotation axis (11*a*) in two directions, and an adjustment lever (12) comprising a dog (14), the lever (12) being pivotable about a rotation axis (12*a*) by interaction between the at least one cam (13) and the dog (14), between two stop or end positions. The dog (14) has a first actuation curve (14*a*) and at least one second actuation curve (14*b*). Interaction between the at least one cam (13) and the first actuation curve (14*a*) on the dog (14) causes no pivoting of the adjustment lever (12), and interaction of the at least one cam (13) with the at least one second actuation curve (14*b*) on the dog (14) initiates pivoting of the adjustment lever (12) between the two stops.

7 Claims, 3 Drawing Sheets

ACTUATING DEVICE

BACKGROUND OF THE INVENTION

1. Field of Invention

The present invention relates to an actuating device or an actuator, particularly for a vehicle door lock.

2. Description of the Related Art

It may be expedient, for example, in central locking systems in motor vehicles, to provide a manual opening option in addition to automatic opening or servo opening. This mechanical back-up can ensure that the central locking system or the individual locks can still be operated even if the vehicle's on-board electronics fail.

However, the provision of a mechanical back-up incurs greater costs and adds weight.

DE 199 13 590 A1 describes a central locking system for a motor vehicle wherein a central locking lever can be moved by an electric motor or automatically, by means of a power take-off pulley formed with eccentric pins. In addition to this automatic movement, manual movement is also possible, the disadvantage being that mechanically and/or electrically produced frictional resistance has to be overcome on account of the electric drive.

EP 0 711 891 B1 describes a vehicle door lock with a central locking drive and a central locking lever driven by it. In this lock a spindle drives a drive element formed with tangs that are operatively connected to a central locking lever 3. Abutment surfaces of a movement receiver of the central locking lever co-operating with the tang are constructed to extend substantially in an arc around the pivot axis of the central locking lever, the central locking drive being controlled by the approach of the tang to this abutment surface.

It is desired to provide an actuating mechanism which can be actuated both electrically and manually by simple means, manual operation being as easy-acting as possible.

SUMMARY OF THE INVENTION

According to one aspect of the invention, an actuating device, particularly for a vehicle door lock, is provided having a cam wheel comprising at least one cam and an adjustment lever comprising a dog. The cam wheel is selectively rotatable about a rotation axis in two directions, and the lever is pivotable about a rotation axis by interaction between the at least one cam and the dog, in particular between two end positions. The dog has a first actuation curve and at least one second actuation curve. Interaction between the at least one cam and the first actuation curve on the dog causing no pivoting of the adjustment lever, and interaction of the at least one cam with the at least second actuation curve on the dog initiates pivoting of the adjustment lever between the two stops moving the dog in the direction of a plane extending through the rotation axis of the adjustment lever and the rotation axis of the cam wheel.

According to a second aspect of the invention, an actuating device, particularly for a vehicle door lock, is provided having a vain wheel comprising a plurality of cams and an adjustment lever comprising a dog. The cam wheel is selectively rotatable about a rotation axis in two directions, and the lever is pivotable about a rotation axis by interaction between a cam from the plurality of cams and the dog, between two stops (15*a*, 15*b*). The dog remains between at least two cams of the plurality of cams. The dog has a first actuation curve and at least one second actuation curve.

Interaction between the at least one cam and the first actuation curve on the dog causing no pivoting of the adjustment lever, and interaction of the at least one cam with the at least second actuation curve on the dog initiates pivoting of the adjustment lever between the two stops, moving the dog in the direction of a plane extending through the rotation axis of the adjustment lever and the rotation axis of the cam wheel.

With the actuating device according to the invention it is possible to have an adjustment lever which can be both electrically driven and manually moved easily and cheaply. Compared with conventional solutions the actuating device according to the invention is characterised by reduced costs and lower weight. The actuating device according to the invention is particularly suitable for use in vehicle locks, including, for example, those which are a part of central locking systems for motor vehicles.

The construction according to the invention of a dog with actuating curves of different shapes provides a simple means of acting upon a cam which is operatively connected to the adjustment lever.

By means of the action on the actuating curve by the minimum of one cam in the direction of a plane passing through the rotation axis of the adjustment lever and the rotation axis of the cam wheel, a substantially reduced movement time or travel time for the adjustment lever can be achieved compared with conventional solutions, i.e. idle strokes can be reduced to a minimum. It has also been found to be advantageous that the adjustment lever in the actuating device according to the invention can be made substantially narrower, i.e. smaller in construction, than was possible in conventional actuating devices. Compared with conventional solutions, the size of the cam wheel which cooperates with the adjustment lever is subject to fewer restrictions than was the case in the prior art. The actuating device according to the invention can be produced in a compact overall size, thus enabling it to be lighter in weight.

According to a preferred embodiment of the actuating device, the first actuation curve (abutment or stop curve) of the dog extends substantially along a circular path about the rotation axis of the adjustment lever, and the second actuation curve runs substantially diagonally, i.e. in an angle to this circular path. This embodiment of the actuation curves can ensure that an interaction between the cams of the cam wheel and the second actuation curve leads to pivoting of the adjustment lever, while an interaction between the cams and the first actuation curve merely transmits radial forces relative to the rotation axis of the adjustment lever onto the dog, so that this does not cause the adjustment lever to pivot.

It has proved expedient to provide two stops which define the end positions of the adjustment lever. These stops serve to define the end positions precisely, i.e. a locking and unlocking position, in particular, when the actuating device according to the invention is used in a lock, for example, and help to minimise the load on a motor which operates the actuating device.

It is preferable to act on the adjustment lever in its end positions by means of spring-type actuating means. Such means can be used to ensure that the adjustment lever remains securely and reliably in one of its end positions.

Conveniently, the spring-type actuating means have a bi-stable spring. A spring of this kind, which is also known as a flip-flop spring, ensures that, when the adjustment lever is acted upon by a cam, it can only safely reach the end positions via part of the adjustment path or pivoting path.

It has proved advantageous to make the cams substantially rectangular or triangular. Cams constructed in this way are relatively easy to produce and by co-operating with the dog according to the invention can ensure the desired interactive effects, i.e. on the one hand the adjustment or pivoting of the adjustment lever on interaction with the first engaging curve and on the other hand locking or self-limiting or self-locking of the pivoting movement on interaction with the second engaging curve. In particular, it is possible to construct the cams pointed, i.e. to come to a point towards the centre of the cam wheel. This makes it possible to minimise the range of interaction in which a blocking interaction between the cam wheel and adjustment lever might occur, which is useful during adjustment, particularly in the event of a loss of current.

The corners between the sides of the cams may be rounded off, for example.

According to a particularly preferred embodiment of the actuating device, three or four cams are distributed around the circumference of the cam wheel. With this many cams, the interactive effects which the invention sets out to provide can be effectively achieved. In particular, this measure further minimises the idle strokes of the cam wheel. The cams may be distributed uniformly or non-uniformly around the circumference of the cam wheel. Overall, the adjustment time of the actuating device can be optimised by a suitable choice of the number of cams, while the use of one, two, five or more cams might be considered, for example.

It has also proved advantageous to construct the cams and/or the dog with a buffer device. The use of buffer means such as rubber buffers or leaf springs minimises the noise produced when a cam meets the dog.

BRIEF DESCRIPTION OF THE DRAWINGS

A preferred embodiment of the invention will now be described in more detail with reference to the accompanying drawing, wherein.

DETAILED DESCRIPTION OF THE PREFERRED EMBODIMENT

Figure 1:
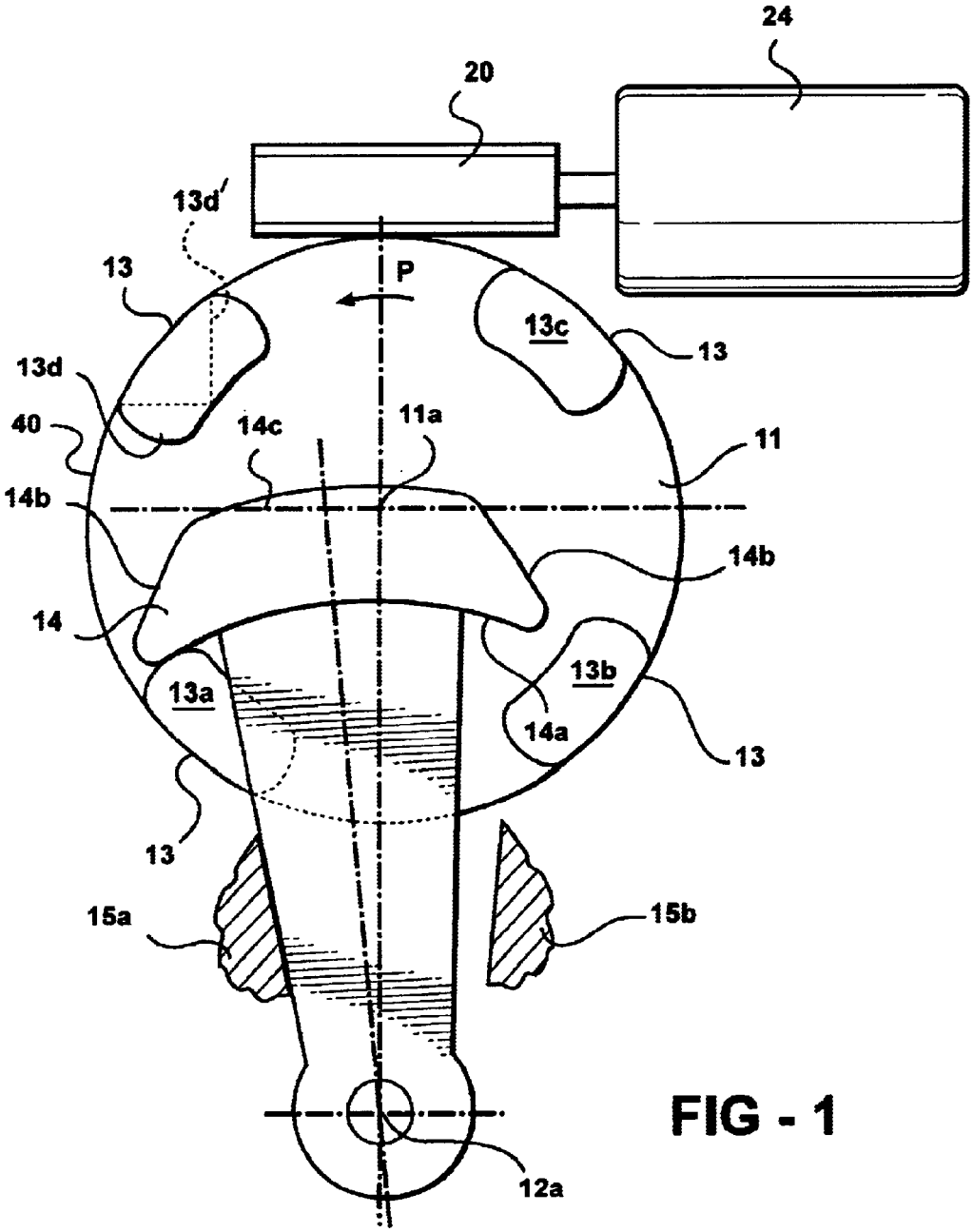
FIG. 1 shows a preferred embodiment of the actuating device according to the invention, in diagrammatic plan view in a first operating position.

In FIG. 1 the device according to the invention is shown diagrammatically and generally designated 10.

The device 10 comprises a cam or worm wheel 11 constructed with at least one cam 13 extending out from the cam wheel 11. In the preferred embodiment, at least one cam 13 includes a plurality of cams 13*a* to 13*d*, each of the plurality of calms 13*a* to 13*d* spaced around the circumference of cam wheel 11. Cam wheel 11 is driven by an electric motor 21. The electric motor 21 is reversible so that the cam wheel 11 can be rotated in both directions of ration about a real or virtual rotation axis 11*a*.

The device 10 further comprises an adjustment lever 12 which is pivotable about a (real or virtual) axis 12*a*.

The pivoting action of the adjustment lever 12 is limited by two stops 15*a*, 15*b* which simultaneously define end positions of the adjustment lever. The end position of the adjustment lever 12 in which the lever abuts on the stop 15*a* corresponds, for example, to a locking position of a locking and unlocking lever of a vehicle lock or a central locking system in a vehicle, and the position of the adjustment lever defined by the stop 15*b* corresponds to an unlocking position.

Mechanisms cooperating with the adjustment lever 12, levers or actuating elements which form part of the overall lock or locking mechanism are not shown in the interests of clarity. However, it should be mentioned at this point that the actuating device shown can be used in particular in the central locking system of a vehicle.

The adjustment lever 12 is retained in its two end positions defined by the stops 15*a* and 15*b* by means of a bi-stable spring (not shown) (flip-flop spring). A spring of this kind also ensures that even without further actuation the lever 12 located in an intermediate position between the end positions is biased into one of the end positions.

The outer end of the adjustment lever 12 is formed, particularly integrally, with a dog 14 which interacts with the cams 13*a* to 13*d* as will be explained hereinafter. The dog 14 projects into the path of rotation of the cams 13*a* to 13*d* while the rest of the adjustment lever 12 is located above or below this path of rotation, expediently substantially parallel to the main direction of the cam wheel 11.

The cams in the Figures are essentially rectangular (with rounded edges). It is also possible to make the cams substantially triangular, i.e. coming to a point towards the rotation axis of the cam wheel 11, as shown for example by the dotted line 13*d*' in FIG. 1.

The dog 14 has a first actuating curve 14*a* (the inner curve relative to the rotation axis 12*a*) and two second actuating curves 14*b*.

The actuating curve 14*a* is constructed so as to extend along a circular path around the rotation axis 12*a* of the adjustment lever 12. The second actuating curves 14*b* run diagonally to this circular path, i.e. the second actuating curves intersect with a circular path of this kind.

The dog 14 also has a third limiting curve 14*c* which extends, for example, concentrically with the first actuating curve 14*a*. In the embodiment shown there is no interaction between the limiting curve 14*c* and the cams 13*a* to 13*d*, although this would be possible in alternative embodiments. As can be seen from FIG. 1 the two second actuating curves 14*b* extend between the first and third curves so that a substantially trapezoidal shape is obtained for the dog 14.

The course of movement of the actuating device according to the invention, produced by the interaction of the cams 13*a* to 13*d* with the dog 14, will now be described in detail.

It should be noted that in order to minimise any noise produced by the interaction between the dog 14 and the cams 13*a* to 13*d*, the cams and/or the dog may be provided with buffer means. A rubber buffer formed on the dog is shown by way of example in FIG. 1 at 19. The surface of this rubber buffer 19 is flush with the rest of the actuating curve 14*a*. Rubber buffers 19 of this kind may be provided everywhere on the dog 14 where there is an interaction with cams. The cams may also be made of a material of this kind.

FIG. 1 shows that the adjustment lever 12 is positioned in the end position defined by the stop 15*a*. In this position the adjustment lever 12 is manually freely pivotable between the two end positions. This means, for example, that even if the drive 20, 21 fails, it is still possible to lock or unlock the vehicle lock as desired.

At the end of the adjustment path the adjustment lever is uncoupled from the drive and can be manually operated without any resistance. In manual operation of the adjustment lever the cam wheel or the drive 20, 21 are not involved. The manual actuation of the adjustment lever between its end positions has proved to be very easy-acting as a whole with the actuating device described above.

Figure 2:
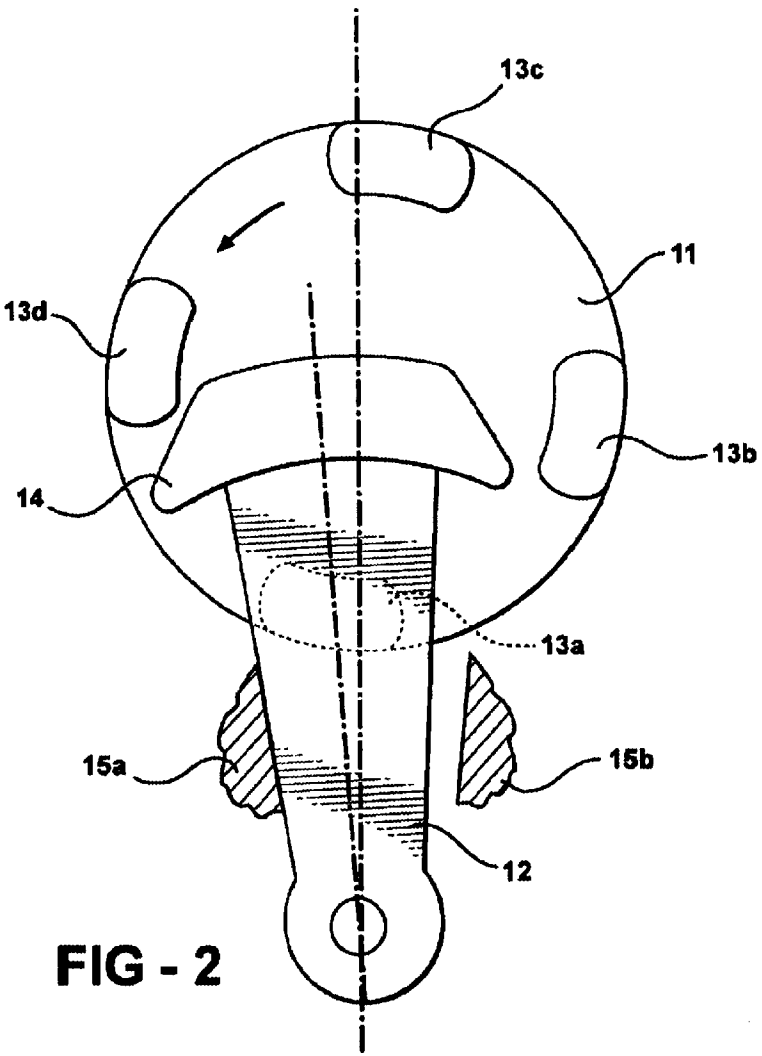
FIG. 2 shows the actuating device according to FIG. 1 in a second operating position.

If the cam wheel 11 now moves anticlockwise (in the direction of the arrow P in FIG. 1) as a result of being driven by the drive 20, 21, initially there is still no interaction between the cams 13*a* to 13*d* and the dog 14. This situation is illustrated in FIG. 2, which shows that the adjustment lever 12 remains in its (left-hand) end position in spite of the movement of the cam wheel 11.

Figure 3:
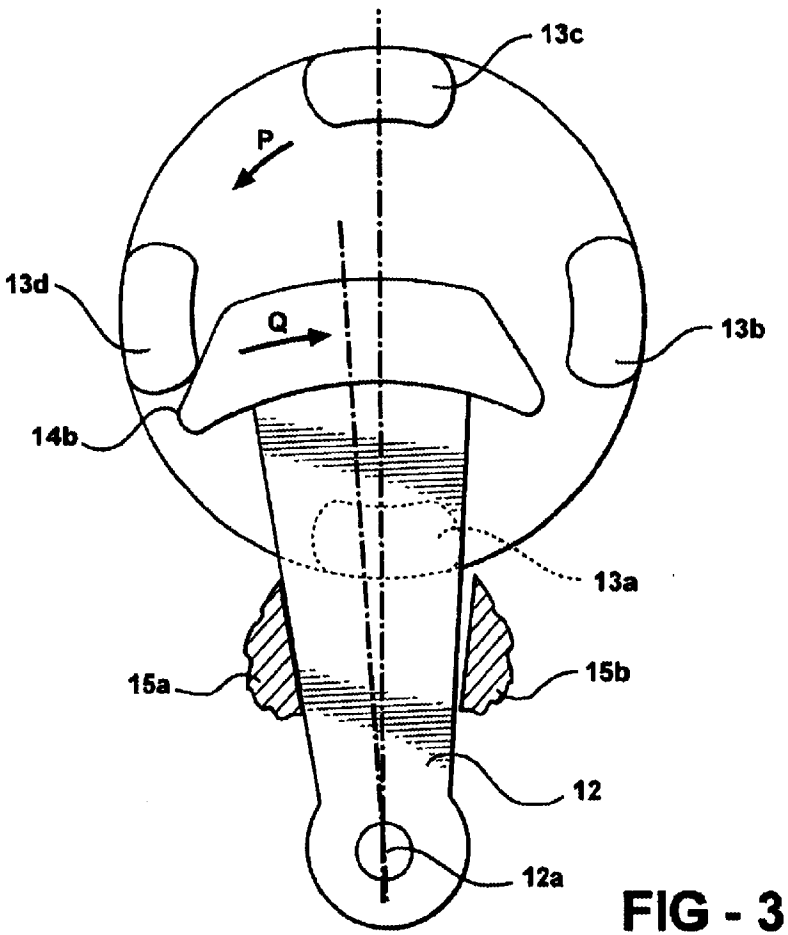
FIG. 3 shows the actuating device according to FIG. 1 in a third operating position.

Only in the rotational position of the cam wheel 11 shown in FIG. 3 is the adjustment lever 12 acted upon by the cam 13*d*. As a result of the interaction between the cam 13*d* and the left-hand actuation curve 14*b* the adjustment lever 12 is pivoted clockwise about the axis 12*a* (indicated by the arrow Q).

The cam 13*d* expediently interacts with the actuation curve 14*b* until the adjustment lever 12 is biased into the second end position defined by the stop 15*b* as a result of the action of the bi-stable spring (not shown).

Figure 4:
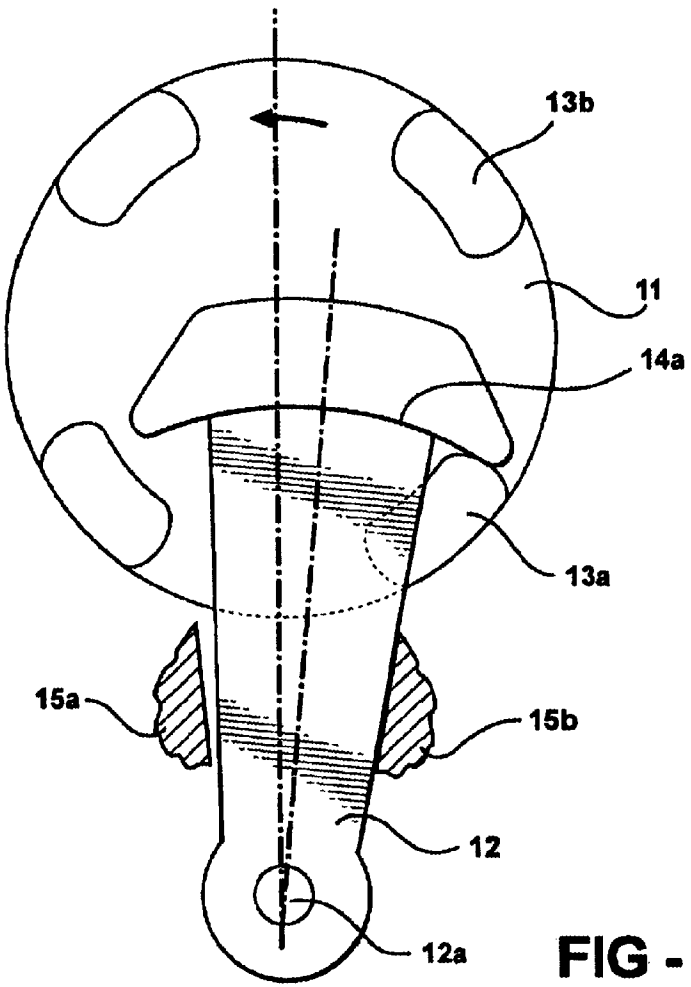
FIG. 4 shows the actuating device according to FIG. 1 in a fourth operating position.

Expediently, at the same time as it reaches the second end position or immediately afterwards, the cam 13*a* meets the first actuation curve 14*a* (as shown in FIG. 4). This prevents the cam wheel 11 from rotating further. As a result of the cam 13*a* coming up against the actuation curve 14*a* the drive movement of the motor 21 meets considerable resistance so that the engine current increases abruptly. This is conveniently evaluated by the circuitry so as to switch off the motor or cut off its current supply.

FIG. 4 also shows, analogously to the situation in FIG. 1, that once again the adjustment lever 12 can be pivoted manually between the end positions defined by the stops 15*a*, 15*b*, independently of any electrical or automatic drive. The manual pivoting must also be deemed particularly easy-acting here, too, as rotation of the cam wheel 11 or of the drive 20, 21 operatively connected thereto and the concomitant frictional effects can be prevented.

Figure 5:
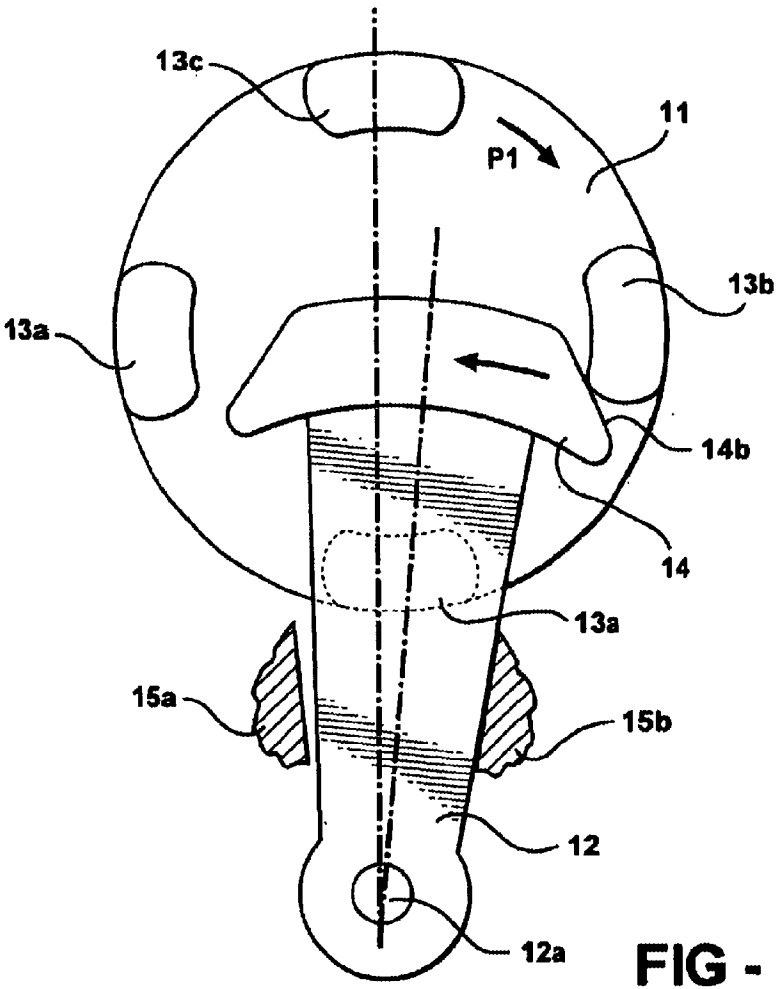
FIG. 5 shows the actuating device according to FIG. 1 in a fifth operating position.

If the adjustment lever 12 is now to be moved back into its original end position, in this case the left-hand end position, by the electric motor, the direction of rotation of the cam wheel 11 has to be reversed by suitably reversing the drive 20, 21. This situation is shown in FIG. 5 in which the rotational movement of the cam wheel 11 (now clockwise) is illustrated by the arrow P'. There is an interaction here between the cam 13*b* and the (right-hand) actuation curve 14*b*.

With regard to the end positions shown in FIGS. 1 and 4, the following should be borne in mind regarding the interaction of the cam 13*a* abutting on the actuation curve 14*a*: in this position the cam 13*a* exerts a purely radial force on the actuation curve 14*a* as a result of the circular path of the actuation curve 14*a* about the rotation axis 12*a*, so that no further force is applied on the adjustment lever 12 about its rotation axis 12*a*. Further displacement of the adjustment lever 12 can thus be prevented. This measure reduces the load of the drive 20, 21 compared with conventional solutions, so that the actuating device according to the invention can be manufactured more cheaply as a whole compared with conventional solutions.

As already explained, the actuating device according to the invention is constructed so that in the event of failure of the electrical drive and the need for manual actuation it is not self-limiting or self-locking. A major advantage of the actuating device according to the invention is that in the case of an override of a central locking system, for example, after a vehicle has been locked by means of the central locking system, the actuating device does not need to be set, and is ready for immediate use. In the situation outlined, there is no need to re-couple the actuating device to the central locking device as the actuating device is always in the redundant or neutral position and can be actuated to close or open the doors by rotation in the corresponding direction.

What is claimed is:

1. An actuating device, particularly for a vehicle door lock, having:

a cam wheel (11), selectively rotatable about a rotation axis (11*a*) in two directions;

at least one cam (13) extending out from the cam wheel, the at least one cam being at least one of rectangular and triangular;

an adjustment lever (12) having a dog (14) having a first actuation curve (12*a*) and at least one second actuation curve (14*b*), the adjustment lever being pivotable about a rotation axis (12*a*) between two positions defined by two stops through interaction between the at least one cam (13) and the dog (14);

wherein interaction between the at least one cam (13) and the first actuation curve (14*a*) on the dog causes no pivoting of the adjustment lever (12), and interaction of the at least one cam (13) with the at least one second actuation curve (14*b*) initiates pivoting of the adjustment lever (12) between the two stops, the dog (14) moving in the direction of a plane extending through the rotation axis (12*a*) of the adjustment lever (12) and the rotation axis (11*a*) of the cam wheel (11).

2. The actuating device of claim 1, wherein the at least one cam (13) is a plurality of cams (13*a* to 13*d*), and each cam of the plurality of cams is distributed around the circumference of the cam wheel (11).

3. The actuating device of claim 2, the actuating device further comprising a buffer, formed on one of the at least one cam (13) and the dog (14), and operable to reduce noise caused by interaction of the at least one cam (13) and the dog (14).

4. The actuating device of claim 1, wherein the first actuation curve (14*a*) on the dog (14) runs substantially along a circular path around the rotation axis (12*a*) of the adjustment lever (12), and the at least one second actuation curve (14*b*) on the dog (14) runs substantially at an angle to the circular path.

5. The actuating claim of claim 4, wherein the dog (14) on the adjustment lever (12) is substantially trapezoidal.

6. An actuating device, particularly for a vehicle door lock, having:

a cam wheel (11), selectively rotatable about a rotation axis (11*a*) in two directions;

a plurality of cams (13*a*to 13*d*) extending out from the cam wheel, each cam of the plurality of cams is distributed around the circumference of the cam wheel (11), an adjustment lever (12) having a dog (14) having a first actuation curve (12*a*) and at least one second actuation curve (14*b*), the adjustment lever being pivotable about a rotation axis (12*a*) between two stops (15*a*, 15*b*) by interaction between the at least one cam (13) and the dog (14), so that the dog remains between at least two cams of the plurality of cams;

wherein interaction between the at least one cam (13) and the first actuation curve (14*a*) on the dog causes no pivoting of the adjustment lever (12), and interaction of the at least one cam (13) with the at least one second actuation curve (14*b*) initiates pivoting of the adjustment lever (12) between the two stops, the dog (14) moving in the direction of a plane extending through the rotation axis (12*a*) of the adjustment lever (12) and the rotation axis (11*a*) of the cam wheel (11).

7. The actuating device of claim 6, wherein the first actuation curve (14*a*) on the dog (14) runs substantially along a circular path around the rotation axis (12*a*) of the adjustment lever (12), and the at least one second actuation curve (14*b*) on the dog (14) runs substantially at an angle to the circular path.

* * * * *

UNITED STATES PATENT AND TRADEMARK OFFICE

CERTIFICATE OF CORRECTION

PATENT NO. : 6,923,480 B2
DATED : August 2, 2005
INVENTOR(S) : Gavriel Shafry

It is certified that error appears in the above-identified patent and that said Letters Patent is hereby corrected as shown below:

Title page,
Insert Item -- [30] Foreign Priority Data
DE 10226355.8 Germany June 13, 2002 --.

Signed and Sealed this

Eighth Day of November, 2005

JON W. DUDAS
*Director of the United States Patent and Trademark Office*